US007037032B1

(12) United States Patent
Marphetia

(10) Patent No.: US 7,037,032 B1
(45) Date of Patent: May 2, 2006

(54) RETAINER FOR USE WITH A VEHICLE TIRE PUNCTURING AND DEFLATING SPIKE AND AN ASSEMBLY THEREOF

(76) Inventor: Toranj Marphetia, 20860 Heatherview Dr., Brookfield, WI (US) 53045-4528

( * ) Notice: Subject to any disclaimer, the term of this patent is extended or adjusted under 35 U.S.C. 154(b) by 0 days.

(21) Appl. No.: 11/252,165

(22) Filed: Oct. 17, 2005

Related U.S. Application Data

(60) Provisional application No. 60/619,978, filed on Oct. 19, 2004.

(51) Int. Cl.
*E01F 13/12* (2006.01)

(52) U.S. Cl. ..... 404/6

(58) Field of Classification Search ... 404/6; E01F 13/12

See application file for complete search history.

(56) References Cited

U.S. PATENT DOCUMENTS 6,045,293 A * 4/2000 Dickinson ..... 404/6
6,312,189 B1 11/2001 Marphetia
6,357,961 B1 3/2002 Marphetia

FOREIGN PATENT DOCUMENTS

FR 2 780 077 * 12/1999

* cited by examiner

*Primary Examiner*—Gary S. Hartmann
(74) *Attorney, Agent, or Firm*—Joseph S. Heino, Esq.; Patrick M. Bergin, Esq.

(57) ABSTRACT

A molded "shear pin" or spike retainer is used with an assembly of tire-puncturing and tire-deflating spikes. The retainer is a solid U-shaped device having at least two straight portions that are connected together by bends. A first retainer portion is dimensioned to be slidingly insertable through a bore that is defined within the base of the spike. The first retainer portion is also dimensioned to be slidingly insertable through opposing apertures that are defined within a spike holder. When the opposing spike holder apertures are aligned with the spike aperture, the spike is spaced above a floor that forms part of a cavity within the spike holder. The first retainer portion holds the spike firmly within the spike holder. In this position, the spike is axially and downwardly movable relative to the spike holder when the first retainer portion is sheared by a downward force exerted on the spike.

20 Claims, 7 Drawing Sheets

RETAINER FOR USE WITH A VEHICLE TIRE PUNCTURING AND DEFLATING SPIKE AND AN ASSEMBLY THEREOF

This application claims the benefit and priority of U.S. Provisional Patent Application 60/619,978 filed Oct. 19, 2004.

FIELD OF THE INVENTION

This invention relates generally to devices that are used by law enforcement agencies and others for intentionally puncturing the rubber tires of a motor vehicle, thereby slowing down and eventually stopping that motor vehicle. More particularly, this invention relates to a device that can be used for retaining a vehicle tire puncturing and deflating spike within an assembly that uses a plurality of such retainers with a like plurality of spikes. It also relates to a spike retainer that is quickly and easily replaced following spike deployment.

BACKGROUND OF THE INVENTION

It is occasionally necessary for law enforcement agencies to impede and stop the movement of a speeding motor vehicle. One method of accomplishing this is by direct pursuit of the vehicle by the vehicles that are used by the agency. However, direct pursuit is a risky proposition since it can and does have the potential for placing the pursuers and the public at large in harm's way, particularly when such pursuits lead through city streets and other populated areas. As one safer alternative to the direct pursuit of an illegally speeding vehicle, it has been recognized that strategic placement of tire-deflating mechanisms in the path, or the anticipated path, of the vehicle can also effectively impede and stop its movement. Such portable tire-deflating mechanisms often take the form of strips of material that can be set down on a roadway, the strips including some sort of puncturing device attached to it. Mechanisms of this type can, in the experience of this inventor, be deployed with relative ease and have taken several forms in recent years. One such mechanism, invented by this inventor, is formed with a "scissors-like" base having a plurality of tire-puncturing spikes that are removably held within the base. That mechanism, including the detail of the tire-deflating spikes that are used with it, is disclosed in U.S. Pat. No. 6,357,961 and U.S. Pat. No. 6,312,189 issued to this inventor, respectively.

In the experience of this inventor, the tire-puncturing spike and retainer assembly as described above has worked superbly in the field. Notwithstanding the improved method of retaining a tire-deflating spike within its assembly, as is disclosed and claimed in U.S. Pat. No. 6,357,961 mentioned above, there are still situations where the vehicle sought to be slowed down or stopped runs over the assembly with such force and in such a violent fashion that the assembly "whiplashes" under or behind the vehicle thereby causing a few extra spikes to be thrown from the assembly. Furthermore, it is this inventor's intended use of the assembly that all spikes that do not have direct tire contact not to be affected and remain intact within the assembly, even when the assembly is whiplashed in this fashion. Accordingly, it is this inventor's intention to further improve the original design of his assembly to further reduce the possibility of spikes being inadvertently deployed when there is no tire contact whatsoever and to do so in such a way as to avoid dramatic alteration of his current configuration of the overall assembly.

SUMMARY OF THE INVENTION

It is, therefore, a principal object of this invention to provide a new, useful, and uncomplicated retainer for holding a tire-puncturing and tire-deflating spike securely within an assembly under all conditions of use except where there is direct tire contact with the spike. It is yet another object of this invention to provide such a spike retainer that requires only a minimal number of elements in order to secure a spike within the assembly, which is easy to use and which allows for ready replacement for a detached spike.

The present invention has obtained these objects. It provides for a molded "shear pin" or spike retainer that can be used with an assembly of the type which has been previously described. The retainer is a solid unitary rod-like device that is formed into a generally "U-shape." That is, the retainer has at least two straight portions that are connected together by bends. A first retainer portion is dimensioned to be slidingly insertable through an only slightly larger dimensioned bore that is defined within the base of the tire-puncturing spike. The first retainer portion is also dimensioned to be slidingly insertable through opposing apertures that are defined within a spike holder. When the opposing spike holder apertures are aligned with the spike aperture, the spike is spaced above a floor that forms part of the cavity within the spike holder. The first retainer portion is inserted and passes through the spike and holder apertures. This holds the spike firmly within the spike holder. In this position, the spike is axially and downwardly movable relative to the spike holder, but only if the first retainer portion is sheared by a downward force exerted on the spike. This first retainer portion is the first leg of the substantially "U-shaped" retainer.

Another portion of the retainer, which is the other leg of the "U-shaped" retainer and which is generally parallel to the first leg, is firmly held in place within another portion of the base assembly. This insures that the spike retainer is held in place until it becomes necessary to deploy the spike. When the spike is impacted by a tire that rolls over it, the spike is forced downwardly, the portion of the retainer that passes through the spike base is sheared off, and the spike is deployed from the base, with the remaining spikes continuing to be retained within the base. The foregoing and other features of this invention will be apparent from the detailed description that follows.

DETAILED DESCRIPTION

Figure 1:
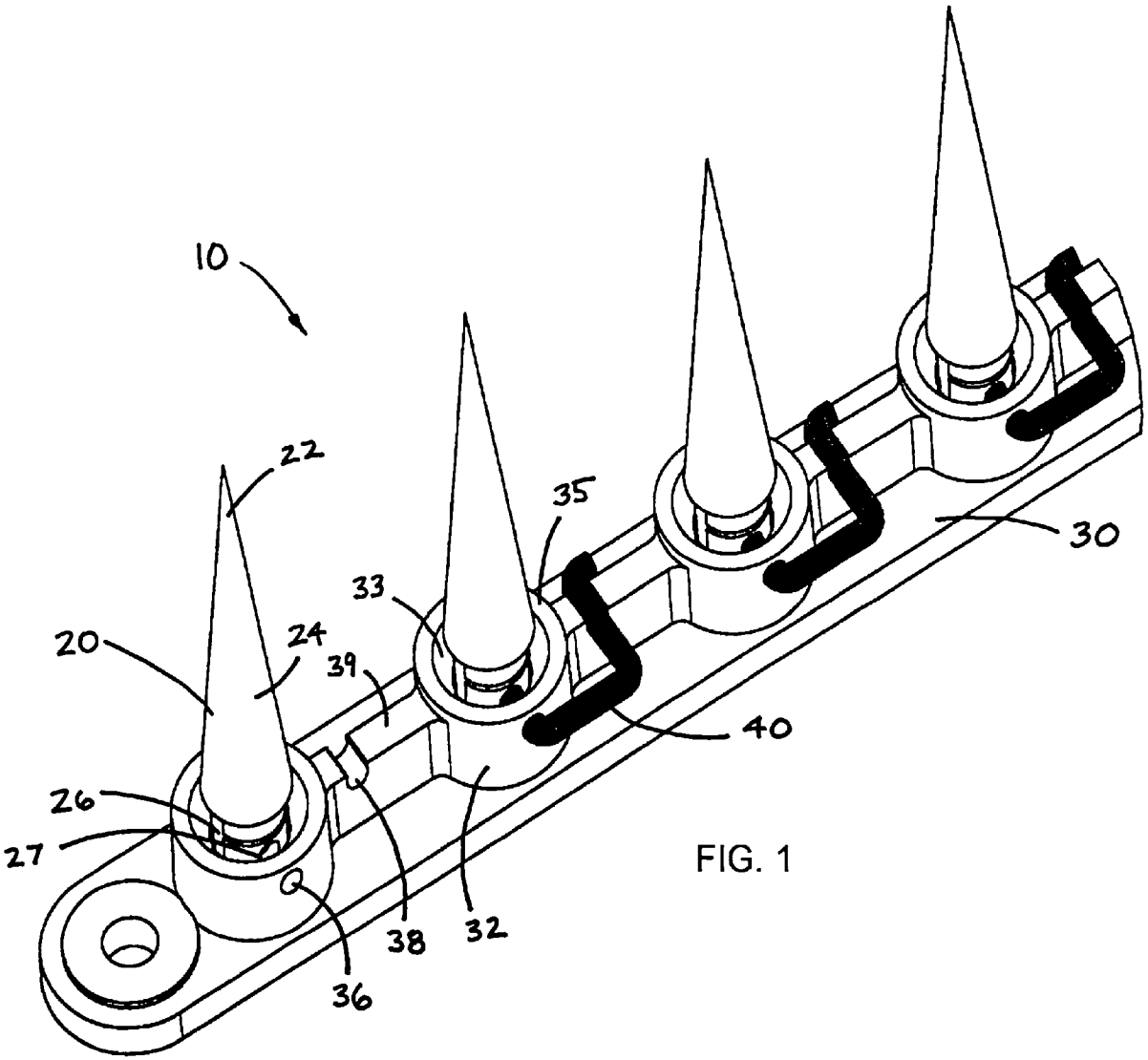
FIG. 1 is a perspective view of a portion of one slat in a spike-deployment assembly that uses a spike retainer in accordance with the present invention.
Figure 7:
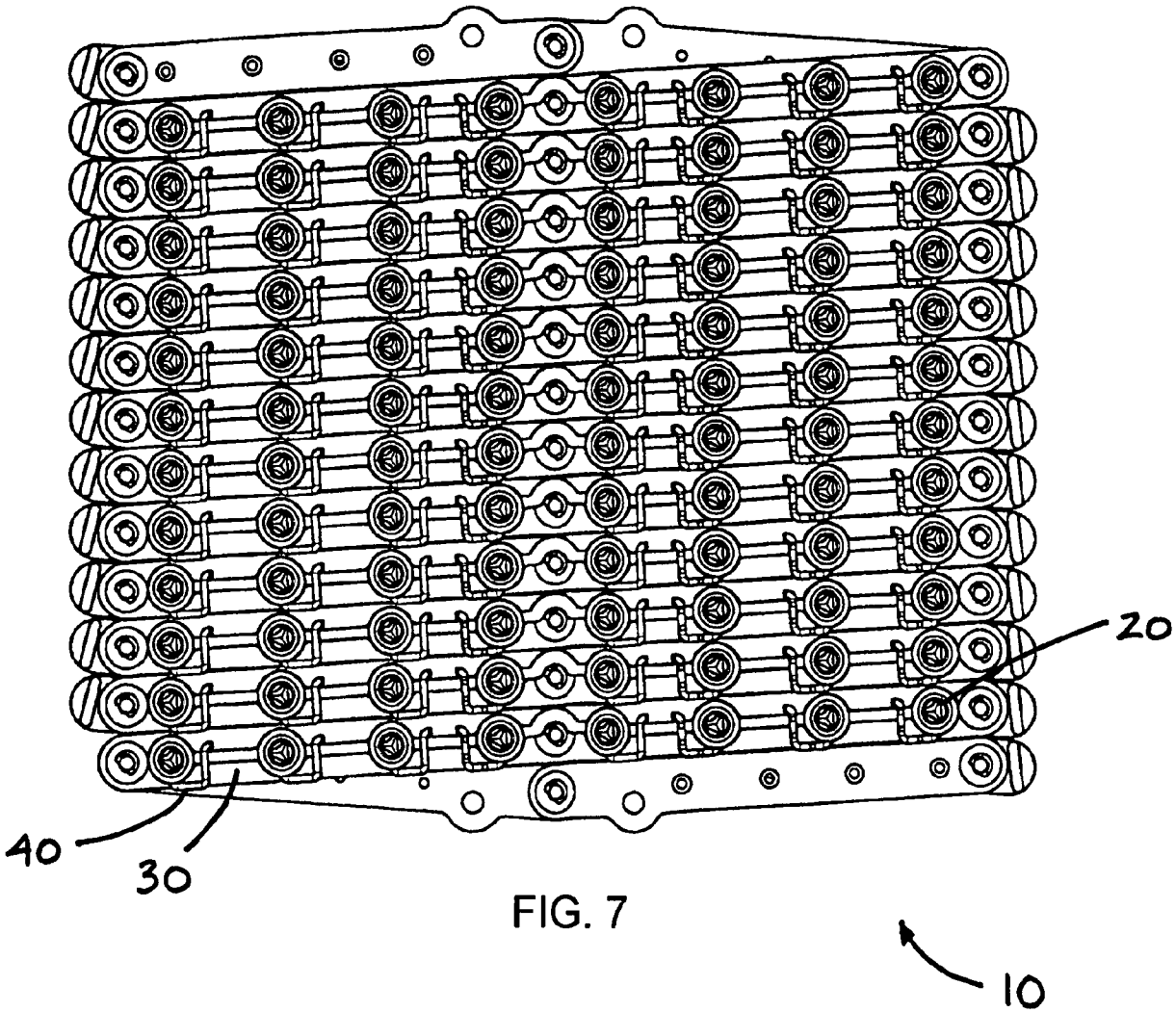
FIG. 7 is a top plan view of an assembly constructed in accordance with the present invention.

Referring now to the drawings in detail, wherein like numbered elements refer to like elements as well, FIG. 1 illustrates a portion of the preferred embodiment of the tire-puncturing and tire-deflating spike retaining assembly, generally identified 10, that is constructed in accordance with the present invention. As shown in FIG. 7, the assembly 10 includes a plurality of spikes, generally identified 20, a plurality of spike holder slats, generally identified 30, and a spike retainer, generally identified 40, one spike retainer 40 being provided for each spike 20.

Referring again to FIG. 1, it will be seen that each spike 20 includes an upwardly pointing spike tip 22, a centrally disposed spike body 24 and a spike base 26. See also FIG. 3. Each spike base 26 is functionally adapted to be received within an axially upright aperture or cavity 34 that is defined within a substantially cylindrical and axially upright spike holder 32. Each slat 30 includes a plurality of such spike holders 32, one for each spike 20. For example, FIG. 7 illustrates an assembly 10 that includes twelve slats 30, each utilizing eight spike holders 32 and a like number of spikes 20. It is to be understood that the exact number of spikes 20, spike holders 32, and slats 30 is not a limitation of the present invention. Any number of such elements could be used without deviating from the scope of this invention.

Figure 2:
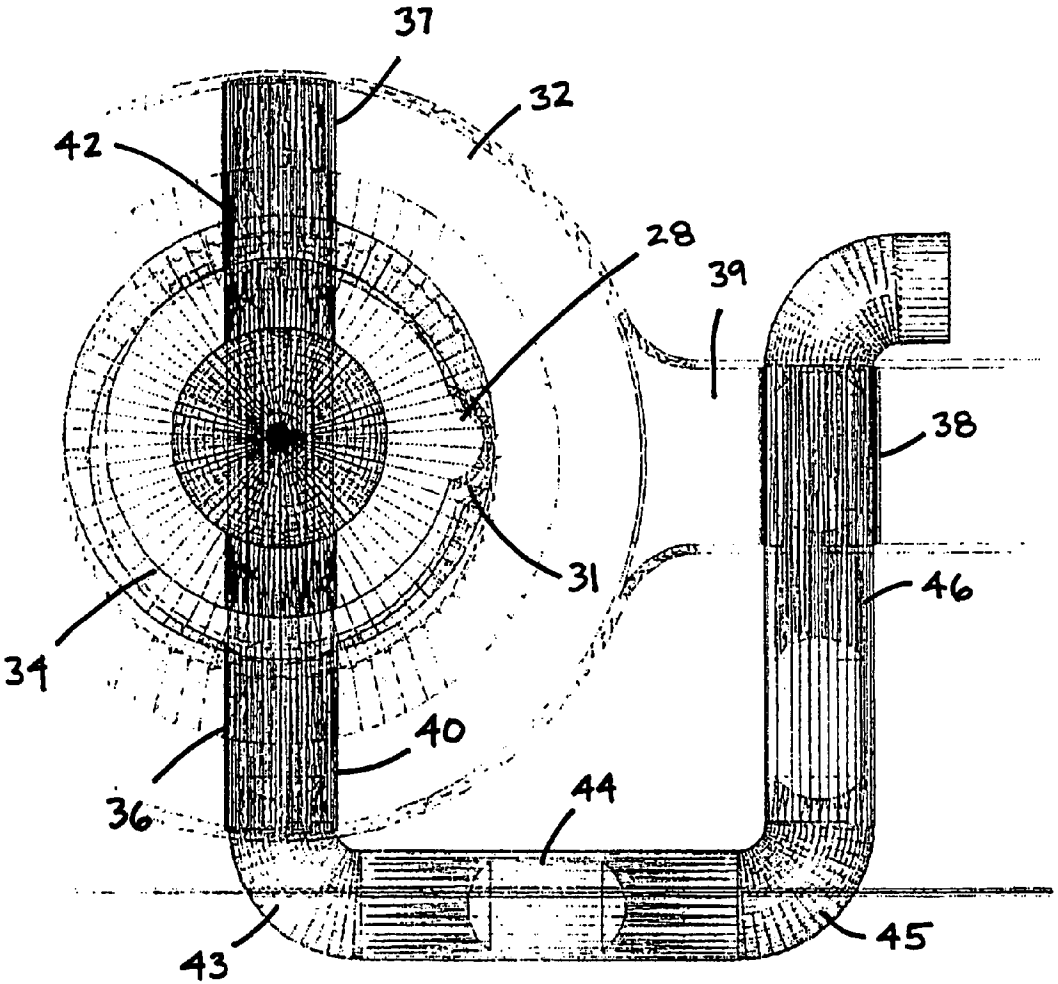
FIG. 2 is a greatly enlarged top plan view of one of the spike retainers illustrated in FIG. 1 and showing the slat in phantom view.
Figure 3:
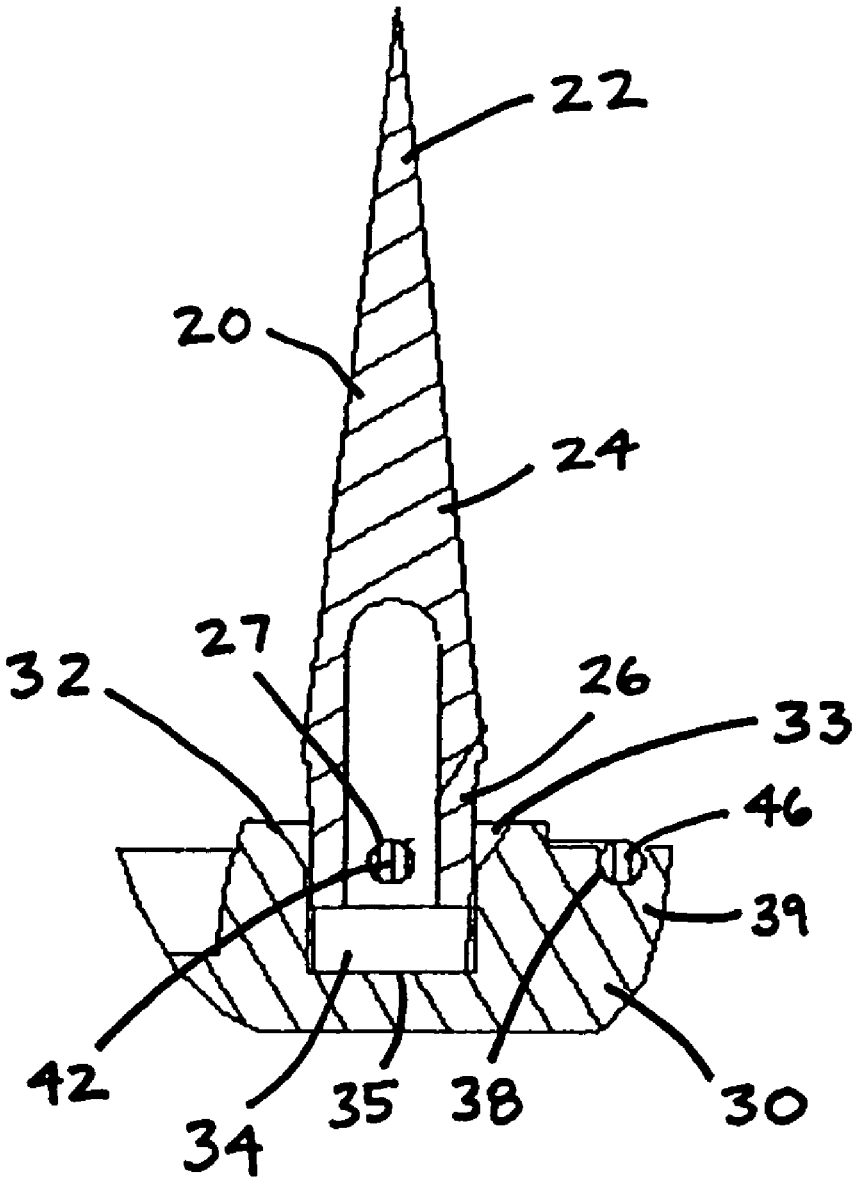
FIG. 3 is a side elevational and cross-sectioned view of one spike and spike retainer of the assembly shown in FIG. 1.

Referring now to FIG. 2, it will be seen that that the base 26 of each spike 20 includes a base alignment ridge 28. As shown in FIG. 3, it will also be seen that each spike 20 includes a transversely-disposed spike base aperture 27. The base alignment ridge 28 of the spike base 26 is receivable within a vertically disposed groove 31 to one side of the spike holder cavity 34. This insures proper rotational orientation of the spike base 26 relative to the spike holder cavity 34 and also assists in proper axial alignment of the base aperture 27 with first and second apertures 36, 37, respectively, that are defined within the spike holder 32. The first and second apertures 36, 37 of the spike holder 32 are also transversely disposed relative to a spike 20 that is held within the holder 32. That is, the first and second spike holder apertures 36, 37, respectively, and the base aperture 27 are aligned such that the axis of each is the same when the spike 20 is properly positioned within the spike holder 32. The importance of this rotational alignment feature is significant although other alignment means may be employed without deviating from the scope of the present invention. Virtually any structure or design that positions the respective apertures 27, 36, 37 in an axial alignment could be used and still come within this invention. Such is not a limitation of the present invention.

Each spike holder 32 includes a cavity counter-bore 33 at the upper edge 35 of the spike holder 32. See FIGS. 1 and 3. This counter-bore 33 is provided to assist in removal of the spike 20 from the cavity 34 when the assembly 10 is used as intended. The significance of this feature will also be apparent later in this detailed description.

Most importantly, the assembly 10 of the present invention includes a retainer, generally identified 40. As shown in FIG. 2, it will be seen that the retainer 40 includes a generally straight first retainer portion 42, a generally straight second retainer portion 44, and a generally straight third retainer portion 46. The first and second retainer portions 42, 44, respectfully, are substantially disposed at a right angle relative to one another and connected by a first elbow 43. Similarly, the second and third retainer portions 44, 46, respectfully, are similarly disposed at a generally right angle and connected by a second elbow 45. In this fashion, the retainer 40 is constructed in a somewhat "U-shaped" configuration. However, other configurations could be used without deviating from the scope of this invention. For example, a truly "U-shaped" retainer could be used. In the experience of this inventor, however, the use of a more angular retainer 40 provides the user with a point or surface (i.e. the first elbow 43) that the user can use to urge the first retainer portion 42 through the aligned apertures 27, 36, 37, the apertures 27, 36, 37 being transversely disposed relative to the axis of the spike 20 and providing some resistance by virtue of a snug fit between those elements, which fit is desired to firmly hold the spike 20 within the holder 32.

In the preferred embodiment, the retainer 40 of the present invention is constructed of a solid material which has some flexibility, but is generally a rigid structure. This rigidity assists the user during insertion of the first retainer portion 42 into the transversely-disposed and linearly-aligned apertures 27, 36, 37. The exact material used is not, however, a limitation of this invention. For example, the retainer 40 can be made of a Minlon® material (a registered trademark of E.I. DuPont de Nemours and Company) which is a nylon resin reinforced with a mineral or mineral/glass combination for low warpage, improved dimensional stability, enhanced stiffness, strength and heat resistance.

In the preferred embodiment, and as previously stated, the first retainer portion 42 is functionally adapted to be inserted into and through the first holder aperture 36, then through the base aperture 27 and finally through the second holder aperture 37. In this fashion, the spike 20 is properly positioned within the holder 32 and is held in a vertical position that is slightly off of and above the floor 35 of the holder cavity 34. The third portion 46 of the pin 40 is functionally adapted to be "snap" received within a hollow 38 that is defined within a ridge 39 extending between adjacent spike holders 32. See FIGS. 1 through 3. The hollow 38 is a generally "C-shaped" cylindrical void which allows the third retainer portion 46 to be securely, but releasably, held within it.

Figure 4:
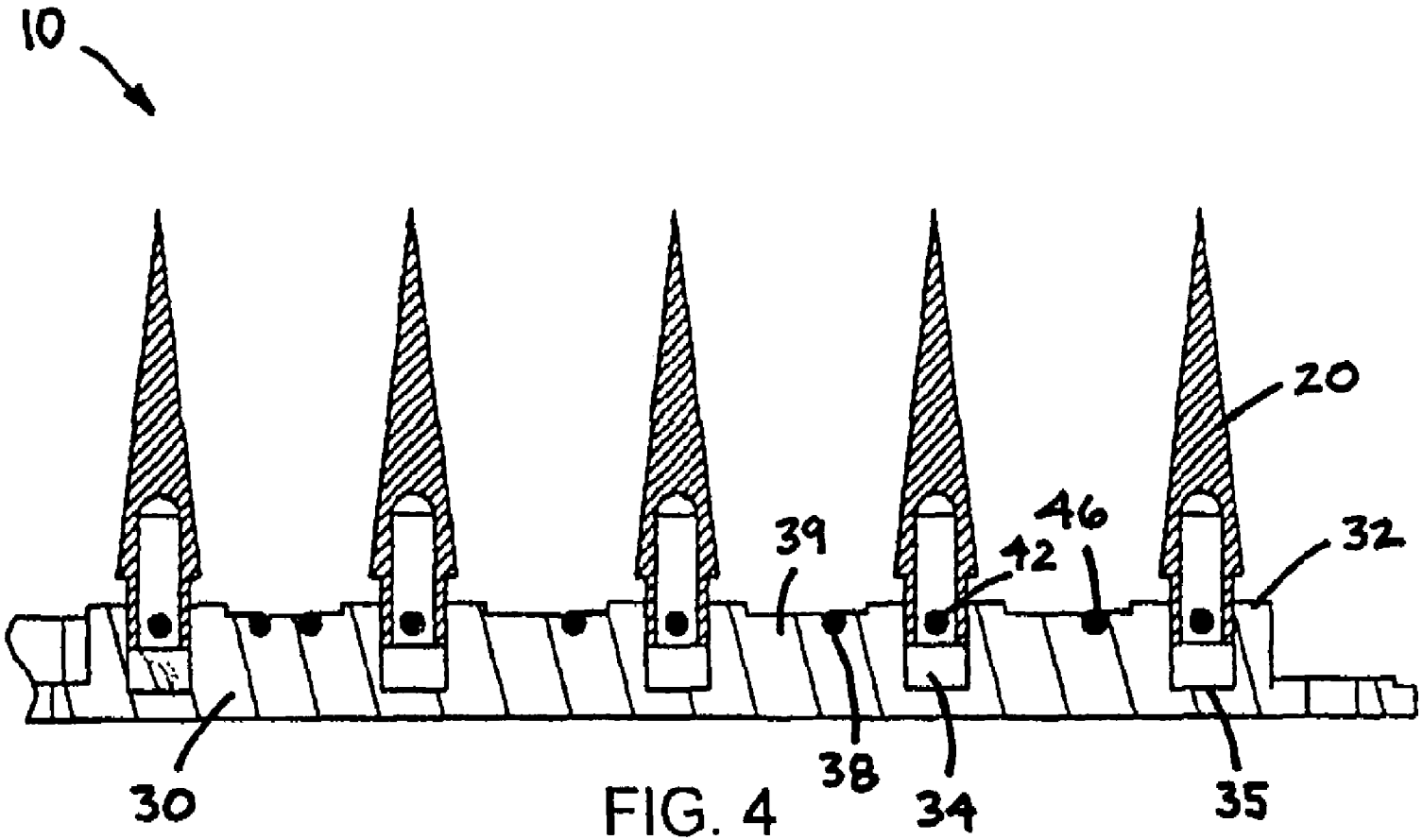
FIG. 4 is a side elevational and cross-sectioned view of one slat in a deployment assembly that shows a plurality of spikes and a plurality of spike retainers held within it.

In application, it will be seen in FIG. 4 that a plurality of spikes 20 are held substantially upright by placement of the spike base 26 into the cavity 34 of a corresponding spike holder 32. In this cross-sectioned view, it will be seen that the first portion 42 of the retainer 40 is held within the aligned apertures 27, 36, 37 and that the third portion 46 of the retainer 40 is held within a corresponding hollow 38. It will be observed that, in this configuration, the base 26 of each spike 20 is held off of the floor 35 of the spike holder cavity 34.

Figure 5:
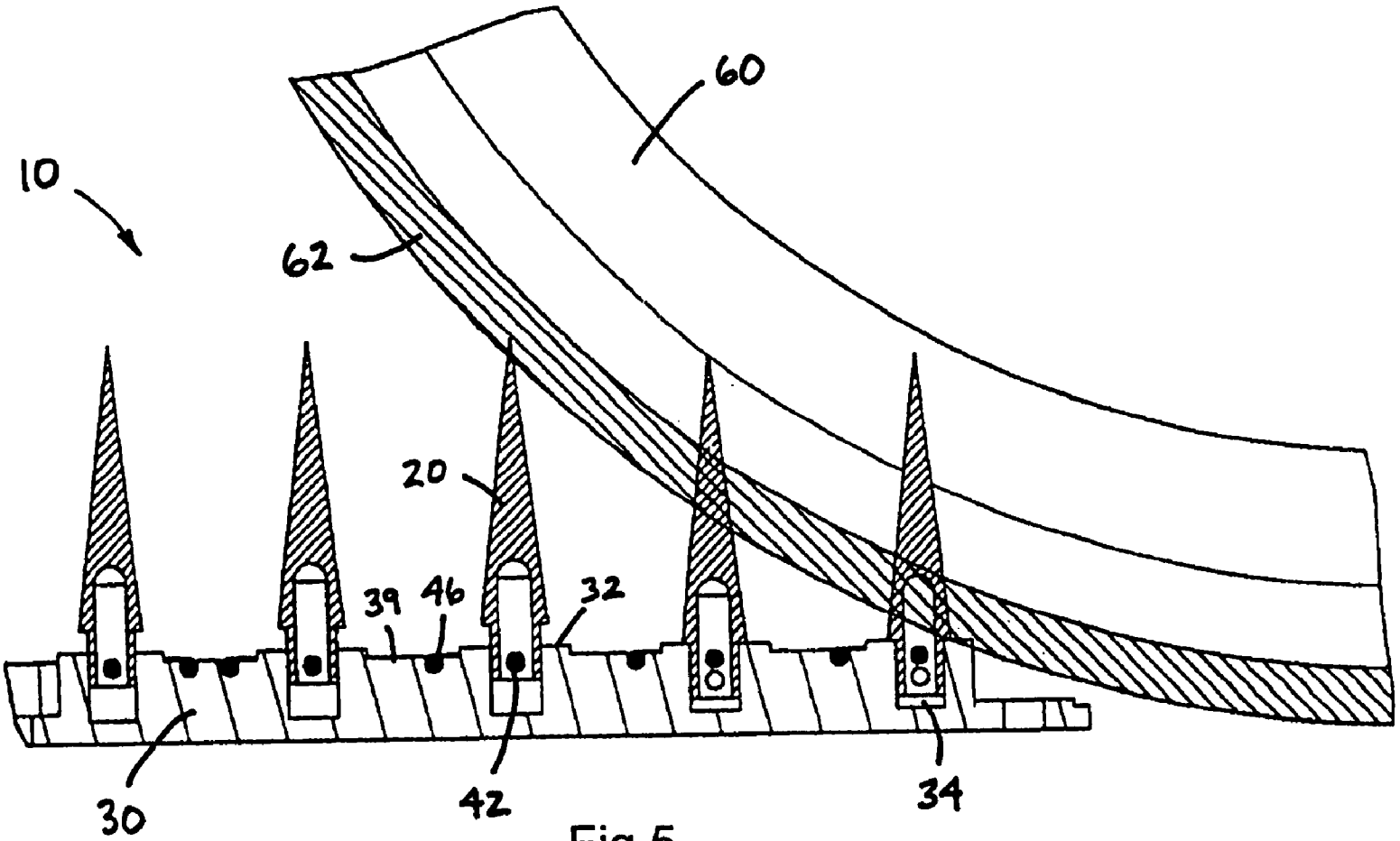
FIG. 5 is the same view of the assembly shown in FIG. 2 but showing a tire initiating contact with one of the spikes, driving that spike downwardly and shearing a portion of the spike retainer.

Referring now to FIG. 5, it will be seen that, as a tire 60 of current manufacture begins to roll over the slat section 30, it impales itself on one or more spikes 20 that are held within that slat section 30. As pressure is exerted downwardly on the spike 20 and the spike tip 22 begins to penetrate the tire tread 62, enough resistance is encountered during tire 60 penetration to force the spike 20 downwardly into the spike holder cavity 34. The downward force exerted on the spike 20 also exerts a shear force between the spike base 26 and the inside surface of the spike holder 32, thereby shearing off the first portion 42 of the retainer 40 at two points, one to either side of the spike base 26.

Figure 6:
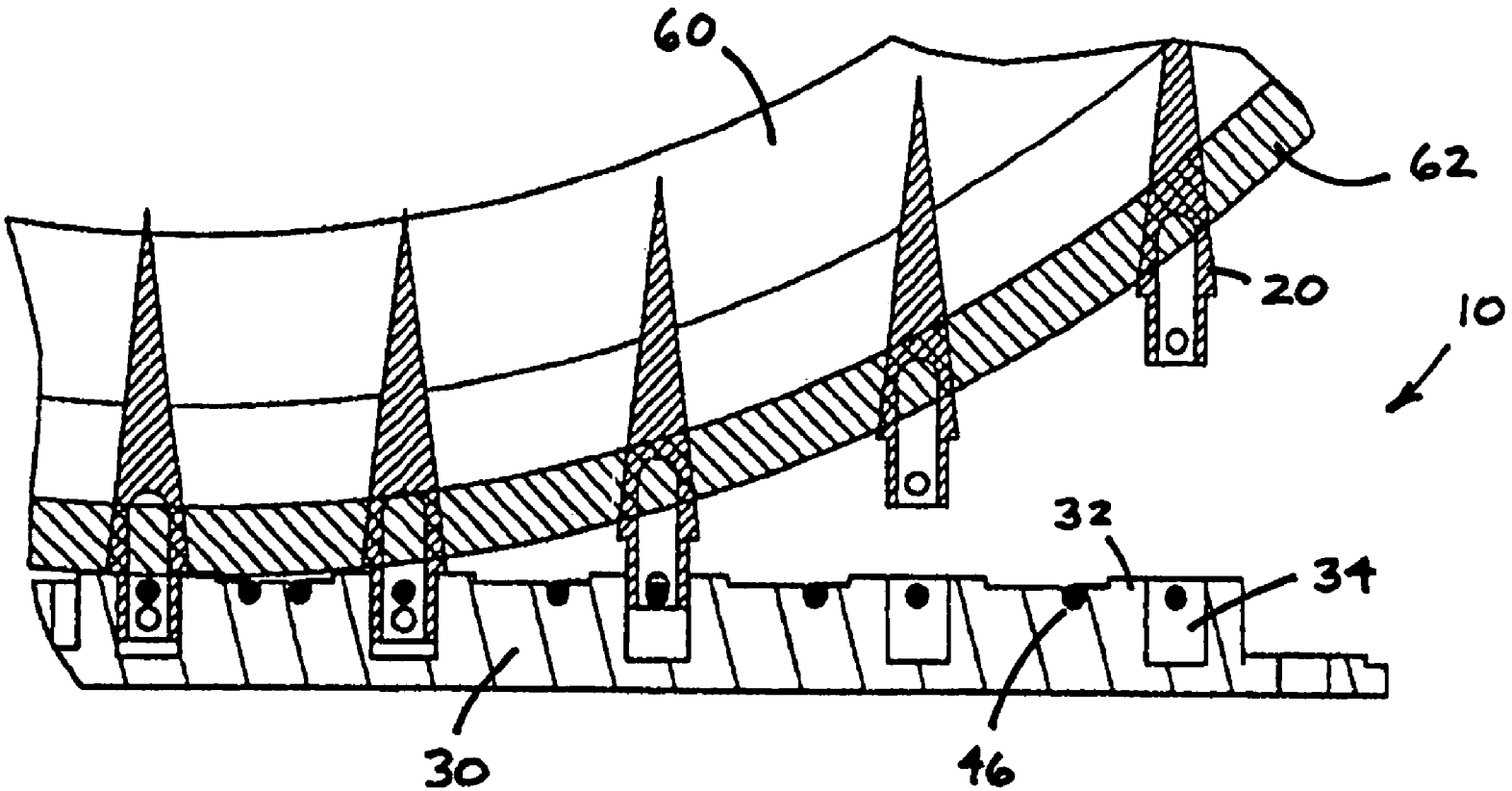
FIG. 6 is the same view of the assembly shown in FIGS. 2 and 3 but showing the tire continuing to roll over the assembly and the deployment of spikes from the assembly.

As the tire 60 continues to roll over the array of spikes 20, as shown in FIG. 6, the spikes 20 are pulled along with the pierced tire tread 62 and pulled from their respective holders 32. Once the retainer 40 is sheared at the base 26 of the spike 20, there is virtually no resistance to the spike 20 being pulled from the slat 30. While FIG. 6 demonstrates an ideal illustration, the spikes 20, in reality, are dynamically twisted in a sideways direction relative to the spike holder 32 as the tire 60 continues to rotate. Though not specifically shown in FIG. 6, it is to be understood that the use of the cavity counter-bore 33 allows the impaled spike 20 to be more easily withdrawn from the spike holder cavity 34 as the tire 60 continues to carry the spike 20 with it. Also in this configuration, spikes that are not impacted by the tread 62 of the tire 60 remain intact within the assembly 10. This further enhances the safety of the assembly 10, making it even more attractive in its use by law enforcement agencies and others who are charged with public safety.

After the assembly 10 has been successfully used, and a number of spikes 20 have been deployed from it, the portion of the retainer 40 remaining from each deployed spike 20 is pulled from the slat hollow 38. A new spike 20, or even the old spike 20 if undamaged, and new retainer 40 may then be reinserted for later use of the assembly 10.

Accordingly, it will be seen that there has been provided a new, useful and non-obvious retainer and assembly for holding a tire-puncturing and tire-deflating spike securely within the assembly under all conditions of use except where there is direct tire contact with the spike; that is uncomplicated and requires only a minimal number of elements in order to secure a spike within the assembly; that is easy to use; and that allows for ready replacement of detached spikes.

I claim:

1. A tire-puncturing and tire-deflating assembly that comprises a plurality of spikes, each spike having an upwardly pointing spike tip, a centrally disposed spike body and a spike base, and each spike base having a transversely disposed spike aperture defined in it, at least one spike holder slat, the spike holder slat having a plurality of spike holders defined in it, each spike holder having an axially upright aperture and a pair of transversely disposed and opposing spike retainer apertures defined in it, and a plurality of spike retainers, wherein a spike retainer is insertable through the spike retaining apertures and through the spike base aperture to retain the spike within the spike holder by frictional engagement.

2. The assembly of claim 1 wherein each spike includes an axial spike alignment means for ensuring the transverse alignment of the spike retaining apertures with the spike base aperture.

3. The assembly of claim 2 wherein the axial spike alignment means comprises an axially extending alignment ridge defined within each spike base and each spike holder has a vertically disposed groove, the alignment ridge being receivable within the groove.

4. The assembly of claim 3 wherein the placement of the alignment ridge within the groove aligns the spike retaining apertures with the spike base aperture.

5. The assembly of claim 2 wherein each spike holder further comprises a counter-bore disposed below the spike base when the spike base is inserted into the spike holder aperture and the spike retainer is inserted into and through the spike retaining apertures and the spike base aperture.

6. The assembly of claim 5 wherein the spike retainer comprises a generally U-shaped structure.

7. The assembly of claim 5 wherein the spike retainer comprises a generally straight first retainer portion, a generally straight second portion and a generally straight third retainer portion, the first and second retainer portions being substantially disposed at a right angle relative to one another and connected by a first elbow, and the second and third retainer portions being similarly substantially disposed at a right angle relative to one another and connected by a second elbow.

8. The assembly of claim 6 wherein the retainer is constructed of a solid material having some flexibility.

9. The assembly of claim 8 wherein the retainer is constructed of a nylon resin reinforced with a mineral or mineral and glass combination.

10. The assembly of claim 9 wherein the slat further includes at least one hollow defined within a ridge that extends between adjacent spike holders, such hollow being functionally adapted to receive a portion of the retainer within it when another portion of the retainer is inserted into and through the spike retaining apertures and the spike base aperture.

11. The assembly of claim 10 wherein the slat hollow is a generally C-shaped cylindrical void that allows the portion of the retainer to be releasably held therewithin.

12. A spike retainer for use in a tire-puncturing and tire-deflating assembly that comprises a plurality of spikes, each spike having an upwardly pointing spike tip, a centrally disposed spike body and a spike base, and each spike base having a transversely disposed spike aperture defined in it, at least one spike holder slat, the spike holder slat having a plurality of spike holders defined in it, each spike holder having an axially upright aperture and a pair of transversely disposed and opposing spike retainer apertures defined in it, which comprises a generally U-shaped structure having a generally straight first retainer portion, a generally straight second portion, and a generally straight third retainer portion, the first and second retainer portions being substantially disposed at a right angle relative to one another and connected by a first elbow, and the second and third retainer portions being similarly substantially disposed at a right angle relative to one another and connected by a second elbow, wherein the spike retainer is insertable through the spike retaining apertures and through the spike base aperture to retain the spike within the spike holder by frictional engagement.

13. The spike retainer of claim 12 wherein each spike holder further comprises a counter-bore disposed below the spike base when the spike base is inserted into the spike holder aperture and the spike retainer is inserted into and through the spike retaining apertures and the spike base aperture.

14. The spike retainer of claim 13 wherein the retainer is constructed of a solid material having some flexibility.

15. The spike retainer of claim 14 wherein the retainer is constructed of a nylon resin reinforced with a mineral or mineral and glass combination.

16. The spike retainer of claim 12 wherein the slat further includes at least one hollow defined within a ridge that extends between adjacent spike holders, such hollow being functionally adapted to receive a portion of the retainer within it when another portion of the retainer is inserted into and through the spike retaining apertures and the spike base aperture.

17. The spike retainer of claim 16 wherein the slat hollow is a generally C-shaped cylindrical void that allows the portion of the retainer to be releasably held therewithin.

18. The spike retainer of claim 12 wherein each spike includes an axial spike alignment means for ensuring the transverse alignment of the spike retaining apertures with the spike base aperture.

19. The spike retainer of claim 18 wherein the axial spike alignment means comprises an axially extending alignment ridge defined within each spike base and each spike holder has a vertically disposed groove, the alignment ridge being receivable within the groove.

20. The spike retainer of claim 19 wherein the placement of the alignment ridge within the groove aligns the spike retaining apertures with the spike base aperture.

* * * * *